US006357146B1

(12) United States Patent
Wordsworth et al.

(10) Patent No.: US 6,357,146 B1
(45) Date of Patent: Mar. 19, 2002

(54) SPORTS FOOTWEAR AND STUDS THEREFOR

(75) Inventors: Elliot David Wordsworth; Jennifer Karen Mitchell, both of London (GB)

(73) Assignee: Mitre Sports International Limited, London (GB)

( * ) Notice: Subject to any disclaimer, the term of this patent is extended or adjusted under 35 U.S.C. 154(b) by 0 days.

(21) Appl. No.: 09/394,631

(22) Filed: Sep. 13, 1999

(30) Foreign Application Priority Data

Sep. 14, 1998 (GB) ..... 9820015

(51) Int. Cl.[7] ..... A43B 5/02; A43C 15/16
(52) U.S. Cl. ..... 36/128; 36/134; 36/67 A
(58) Field of Search ..... 36/126, 128, 127, 36/59 R, 59 C, 62, 67 A, 67 B, 67 C, 67 D, 134

(56) References Cited

U.S. PATENT DOCUMENTS

| | | | | |
|---|---|---|---|---|
| 2,053,906 | A | * | 9/1936 | Fuller |
| 3,129,520 | A | * | 4/1964 | Funck |
| 3,352,034 | A | | 11/1967 | Braun |
| 3,577,663 | A | | 5/1971 | Mershon |
| 4,060,917 | A | * | 12/1977 | Canale |
| 4,180,923 | A | * | 1/1980 | Dassler |
| 4,233,759 | A | * | 11/1980 | Bente et al. |
| 4,327,503 | A | * | 5/1982 | Johnson |
| 4,393,604 | A | * | 7/1983 | Crowley |
| 4,642,917 | A | * | 2/1987 | Ungar |
| 4,914,838 | A | * | 4/1990 | Ihlenburg |

FOREIGN PATENT DOCUMENTS

| | | |
|---|---|---|
| DE | 10 73 907 B | 1/1960 |
| DE | 31 12 389 | 10/1982 |
| DE | 33 42 397 | 11/1983 |
| DE | 32 35 415 A1 | 3/1984 |
| EP | 0 815 759 | 7/1997 |
| JP | 7-275004 | 10/1995 |
| WO | WO 95/22915 | 8/1995 |

* cited by examiner

*Primary Examiner*—Ted Kavanaugh
(74) *Attorney, Agent, or Firm*—Akin, Gump, Strauss, Hauer & Feld, L.L.P.

(57) ABSTRACT

Sports footwear having a sole studded with a plurality of directional studs, said directional studs being shaped to present a higher resistance to movement through a flowable ground surface in one radial direction of the stud than in the opposite radial direction of the stud, by means of stud conformation including an abrupt drive face, providing a drive side of the stud directed in one direction along a drive line corresponding to the stud's direction of maximum resistance to movement through a flowable medium, and flank regions diverging from the drive line towards respective shoulder regions bordering the drive side, thereby providing a compliant side of the stud directed in the opposite direction along the drive line.

10 Claims, 4 Drawing Sheets

Fig. 2(a)
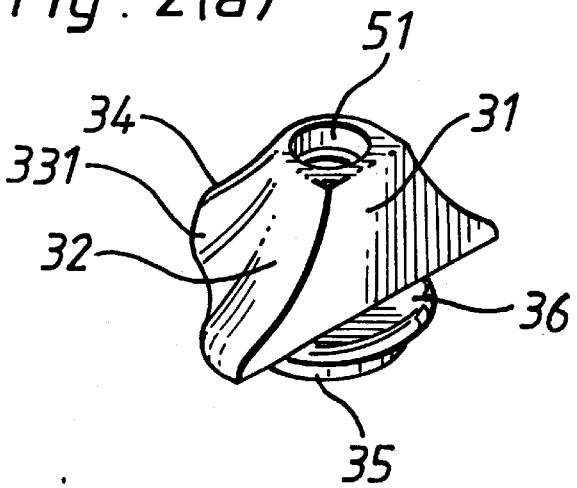
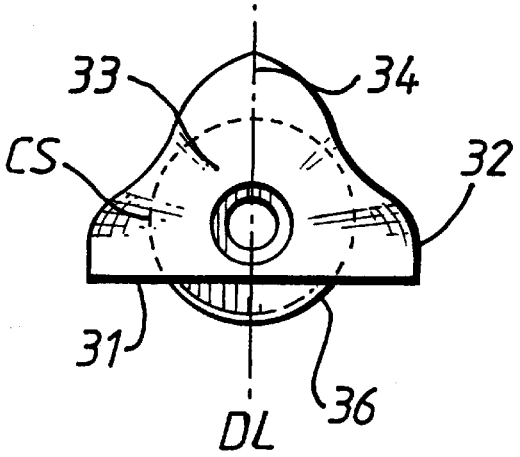
Fig. 2(b)
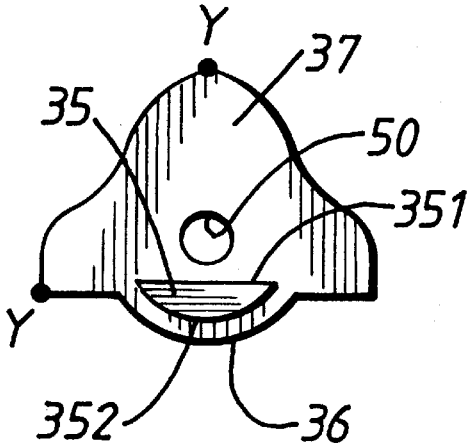
Fig. 2(c)
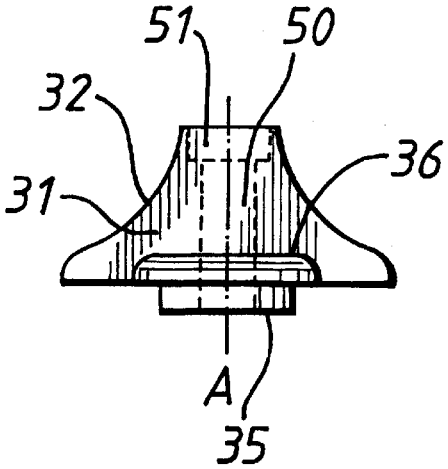
Fig. 2(d)
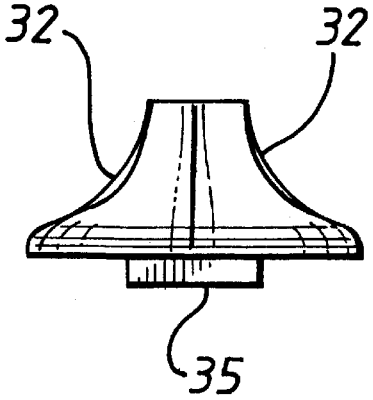
Fig. 2(e)

Fig. 2(f)
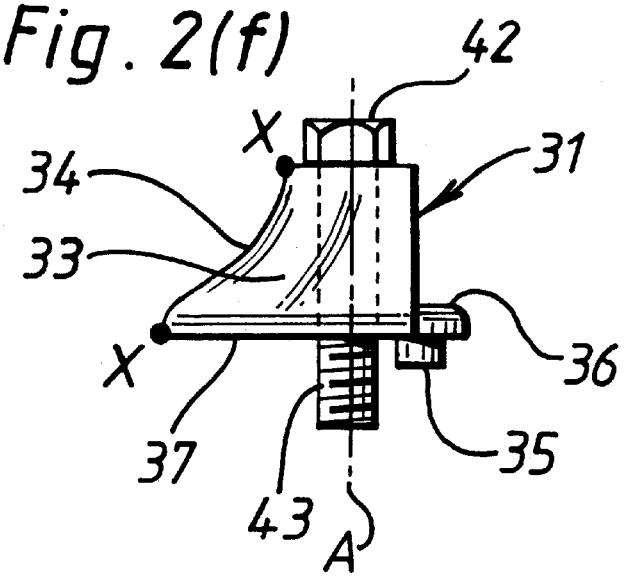
Fig. 2(g)
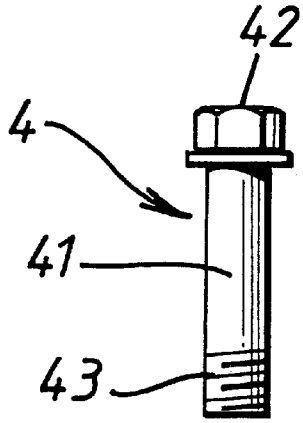
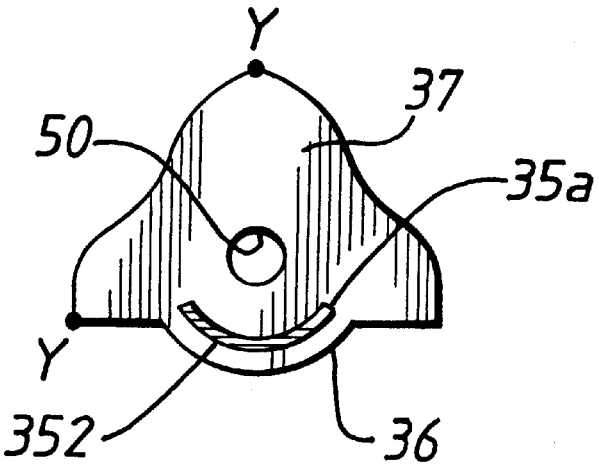
Fig. 4

SPORTS FOOTWEAR AND STUDS THEREFOR

FIELD OF THE INVENTION

This invention concerns sports footwear with studded soles, such as football boots, rugby boots and hockey boots, and particularly relates to novel kinds and arrangements of studs for these.

BACKGROUND OF THE INVENTION

Conventionally studs are cylindrical or frustoconical projections from the sole. Recently-available designs have non-circular studs in the form of straight or curved fins, or triangles. These are designed to be visually distinctive; they may also affect ground penetration and grip.

Studs may be moulded integrally with a plastic sole unit. It is also known for circular or triangular studs to be fixed detachably by threaded bolts which screw into threaded sockets embedded in the sole. In the latter case the stud body generally has a polygonal portion or other flats for engagement by a spanner.

See e.g. US-A-4590693 and EP-A-815759.

SUMMARY OF THE INVENTION

We now disclose new and useful developments in this field as regards the shape and mounting of studs.

Our first proposal relates to studs shaped with non-circular symmetry. We have found that such studs can be designed to tailor the grip properties of the footwear in different directions of foot action, and that the behaviour of a ground surface penetrated by a stud is to some extent fluid, depending on how wet it is, making the horizontally-directed fluid dynamic profile of the stud a significant factor in its behaviour.

Thus the first set of proposals relates to the shape of studs.

For convenience in describing directional studs we shall use the term "drive line" which is a median line (radial, for a rotationally-fastened stud) in the direction of the stud's maximum flow resistance.

A stud will naturally project the same area in opposite directions along the drive line, but directional properties can be achieved by adjusting the angular presentation of the stud surface relative to the drive line in these two directions. In general terms we propose a directional stud which has one or more relatively abrupt faces presenting a first resistance to movement of the stud in a first radial direction through a flowable ground material at the drive side, facing along the drive line, and a relatively inclined or convergent face or faces on the other side which can be termed the compliant side presenting a second resistance to movement of the stud directed radially oppositely to the first radial direction.

An abrupt face desirably extends substantially parallel to the stud axis, preferably within 10 degrees of parallel, and transverse to the drive line. Preferably it is substantially flat; alternatively it may be recessed relative to its own border (i.e. concave). Desirably such abrupt face accounts for at least 40% or preferably at least 50 or 60% of the total stud area projected along the drive direction in situ.

The compliant side has more inclined face than the drive side to reduce its relative flow resistance. Consequently, the first resistance of the abrupt drive face is greater than the second resistance of the compliant side. Preferably the inclined face is provided as flank regions which diverge in the drive direction towards shoulders where they meet the drive side. The inclined face is preferably inclined to the stud axis, i.e. axially convergent, by at least 30 degrees or 40 degrees. Preferably inclined face is divergent from the drive line by not more than 60 degrees, preferably not more than 50 degrees. Such surface may be flat, or more preferably concave as discussed further below. Preferably it is generally smooth to improve flow.

Desirably such inclined face accounts for at least 50% or preferably at least 60% or 70%, of the total stud area projected along the reverse of the drive direction in situ. Indeed, inclined face having one or both of axial convergence and plan divergence may account for upwards of 80% of that area.

Preferably divergent flank regions on the compliant side lead to shoulders of the abrupt face on the drive side. For a combination of ground penetration with suitable face inclination it is preferred that the flank regions and the shoulders, preferably also a median ridge where the flank regions meet, are axially convergent as specified above. Any one and preferably all of these axially convergent features is/are desirably also concave in axial section. This keeps down the ratio of the radial cross-sectional area relative to the penetrant area of drive face at a given depth.

Providing axial convergences and face inclinations relative to the direction transverse to the drive line enables the stud to become relatively compliant in that direction too. This lateral compliance can help to reduce leg injuries associated with undesirable stud resistance to sideways and twisting movements of the foot. For football, a forward inclination of the stud also reduces difficulties in getting the toe down under the ball for kicking.

A particularly preferred form of stud has a shaped stud body, preferably a plastics moulding, penetrated by an axial securing bolt whose drive head is exposed at the top of the stud and whose threaded end projects below a base plane of the stud. The stud body has a generally flat drive face on the drive side, substantially perpendicular to the horizontal drive line. The flat drive face is bordered at the sides by lateral shoulders which converge towards the top of the stud body, preferably at least 30 degrees relative to the axial direction overall from the base to the top of the stud body, and which preferably are concave. On the compliant side the stud has divergent flank faces diverging from a median ridge at their meeting to the respective shoulders, and which converge axially towards the top of the stud body as does the median ridge. Convergence to the top of the body is preferably at least 40 degrees (overall from top to bottom) relative to the axial direction. Preferably the median ridge and most preferably also the flank faces are concave at least in axial planes and, for the faces, also in radial planes.

A second independent aspect of our proposal relates to studs releasably securable to the sole by engagement of a rotational fastener portion of the stud with a complementary rotational fastener portion of the sole, e.g. screw-threaded portions. In addition to its fastener portion the foot of the stud has a stud alignment formation, extending off-axis and engageable to overlap axially with an alignment formation of the sole to hold a predetermined rotational orientation of the stud relative to the sole when securing the stud.

Preferably the rotational fastener portion of the stud is rotatable relative to the stud's alignment formation. The fastener components can then be rotated to a secure or tight condition after the stud is locked at the desired orientation. For this purpose an axial freedom of movement of the stud's fastener portion relative to the alignment portion is also desirable, making it easier to move the alignment portion into engagement after initially engaging the fastener, or vice versa.

The stud's fastener portion is conveniently an axial bolt, e.g. a threaded bolt, projecting below the foot of the stud body. The stud's fastener portion may be a discrete component housed in a stud body component, e.g. a metal fastener housed in a moulded plastics stud body since this corresponds closely to familiar constructions. A drive head for the fastener portion of engagement by a fastening tool, e.g. a hexagonal or other polygonal head, may project from or be exposed at the top of the stud body.

The alignment formations may be chosen from a wide range of possibilities, provided that when engaged (with an axial overlap) they prevent rotation of the stud in at least one and preferably both rotational senses. However we note a number of criteria leading to preferred constructions. For ease of manufacture and durability, the alignment formations on the stud and/or sole are desirably fixed, integral formations e.g. moulded in one piece. There may be for example one or more localised projections or lugs on one component engageable in one or more corresponding recesses, preferably substantially complementary in shape, on the other. Preferably a projection is on the stud body and a recess on the sole, since projections are more susceptible to damage and the stud is more easily replaced. It is also possible to have the recess on the stud and a projecting lug on the sole. It may also be desired to allow conventional flat-bottomed studs to be used on the same sole; a projection on the sole might hinder this.

Alternatively the stud's foot as a whole may be eccentric or non-circular in some respect and sit bodily in a complementary or at least rotation-inhibiting recess of the sole.

Preferably the alignment formations lock a unique rotational orientation, but in some contexts it may desired to provide multiple rotational symmetry so that there are two or more lockable orientations.

The resultant ability to ensure a predetermined rotational orientation of a stud may be useful for a variety of functional and/or aesthetic reasons for studs which in some respect lack full circular symmetry. We particularly envisage its use for studs shaped to have higher flow resistance in one radial direction than in a transverse radial direction e.g. elongate fin shapes, (perhaps with two-fold symmetry), or than in the opposite radial direction (e.g. triangular shapes, and/or shapes with substantially one-fold or three-fold symmetry). In particular it may be used in conjunction with the first aspect discussed previously.

A third independent aspect of the present proposals, which may be used in conjunction with the first and/or second aspects above, relates to the disposition of directional studs on the sole of the footwear.

As to the number of studs, this may be in accordance with conventional layouts. Thus, the total number of studs is typically from 4 to 12. There may be from 3 to 8 studs in the forefoot region and 2 to 4 studs in the rearfoot (heel) region, usually with a stud-free area at the instep.

The forefoot plays the major part in forward drive and turning; while sprinting the rearfoot makes little significant contact with the ground. The rearfoot is important in slower running when the foot lands and when slowing down. It is desirable as part of the "braking phase" of running and to minimise slipping of the relevant part of the foot. Thus, we propose firstly that most or all of the directional studs of the forefoot or first part of the sole (which may be a majority or all of the studs of the forefoot) have the drive side facing rearwardly or towards a second part of the sole. Conversely, most or all of the directional studs (generally a majority or all of the studs) at the rearfoot or second part of the sole have the drive (high-resistance) side directed forwards or towards the first part of the sole.

BRIEF DESCRIPTION OF THE DRAWINGS

Examples of the invention are now described with reference to the accompanying drawings, in which

FIG. 2 parts (*a*) to (*f*) are respectively a perspective view, top view, bottom view, drive side view, compliant side view and transverse view of a stud;

FIG. 2(*g*) is the securing bolt thereof,

FIG. 4 corresponds to FIG. 2(*c*) but shows a modification.

DETAILED DESCRIPTION OF PREFERRED EMBODIMENTS

Figure 1:
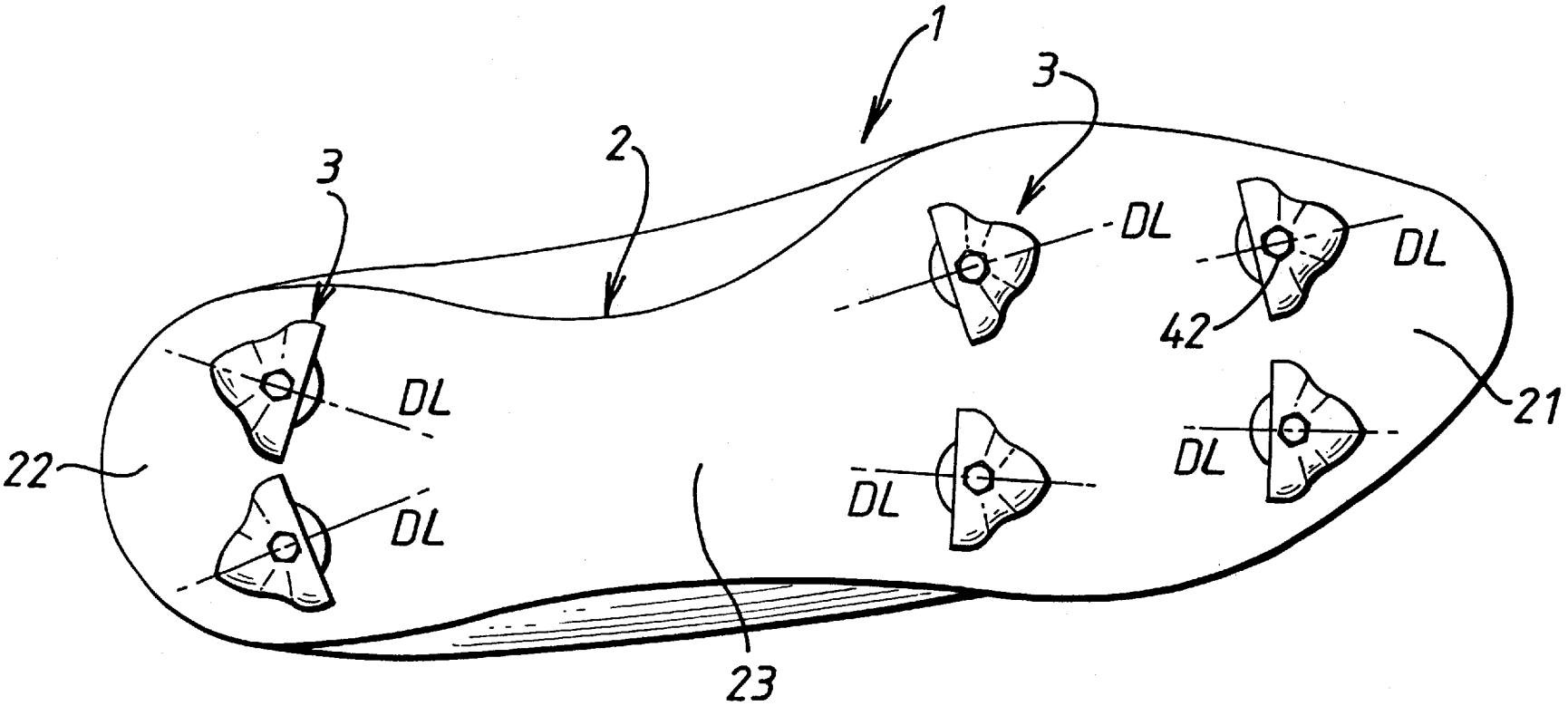
FIG. 1 is a planned view of the sole of a football boot with studs attached.

The example is a football boot 1 with a moulded plastics sole unit 2 mostly of conventional form, having forefoot and rearfoot (heel) regions 21, 22 separated by an instep region 23. Six detachable studs 3 are arranged on the sole in the conventional configuration i.e. four on the forefoot and two at the rearfoot, with the instep 23 unstudded.

FIGS. 2(*a*) to (*g*) are various views of a stud 3 and its features and components. All of the studs on the sole may be identical although their dispositions on the sole and effects vary, and this is convenient for manufacture and replacement. However there may be advantages in having taller studs (i.e. studs which project further beneath the sole) in the rearfoot area, e.g. projecting 16 mm whereas forefoot studs project 14 mm. Such taller studs may be desirable for use also on the forefoot in very soft ground.

Each stud has a stud body having a vertical hole 50 through which a fastening bolt 4 passes in a axial direction A. The bolt 4 is generally conventional having a hexagonal head 42 and a straight shaft 41 with a threaded end 43 to engage in correspondingly threaded female metal inserts 24 let into the sole 2 in a manner which in itself is well known. A tightening spanner is normally used.

The stud body 3 is preferably a single moulding of plastics material e.g. nylon. Its form is that of a triangular pyramid, with one-fold rotational symmetry around the axis A but mirror symmetry at an axial plane containing the horizontal drive line DL. The drive side of the stud body 3, i.e. that side directed along the drive line DL, consists essentially of a flat drive surface 31 perpendicular to the drive line. With the stud installed the drive surface 31 is also perpendicular to the sole, since the stud body 3 has a planar base surface 37 which lies on a corresponding flat region 25 (FIG. 3) of the sole 2, the base surface 37 is perpendicular to the axis A and the drive surface 31 perpendicular to the base surface 37. At the centre of the foot of the drive surface 31, the drive side has a forward flange 36, in the shape of a circular segment coaxial with the stud axis A, and whose lower surface is a continuation of the flat base surface 37.

A locating lug 35 projects down from the stud body base surface 37 immediately in front of the bottom opening of its bolt hole 50. In this embodiment the lug 35 is of substantially uniform radial cross-section with a flat rear face 351 and a part-cylindrical front face 352 concentric with the stud body axis A and front flange 36, under which it partly lies. The lug 35 is formed in one piece with the stud body.

As shown in FIG. 1 the studs are to be mounted with their drive surfaces 31 in the orientations shown. Specifically, their drive lines DL are generally oriented with the longitudinal drive axis of the sole, corresponding to the line of action of the foot when running. At the forefoot the drive surfaces 31 are directed rearwardly to provide grip upon acceleration. At the rearfoot the drive surfaces are directed forwardly to provide grip in slower running and on deceleration, when the heel plays a more important part.

Figure 3:
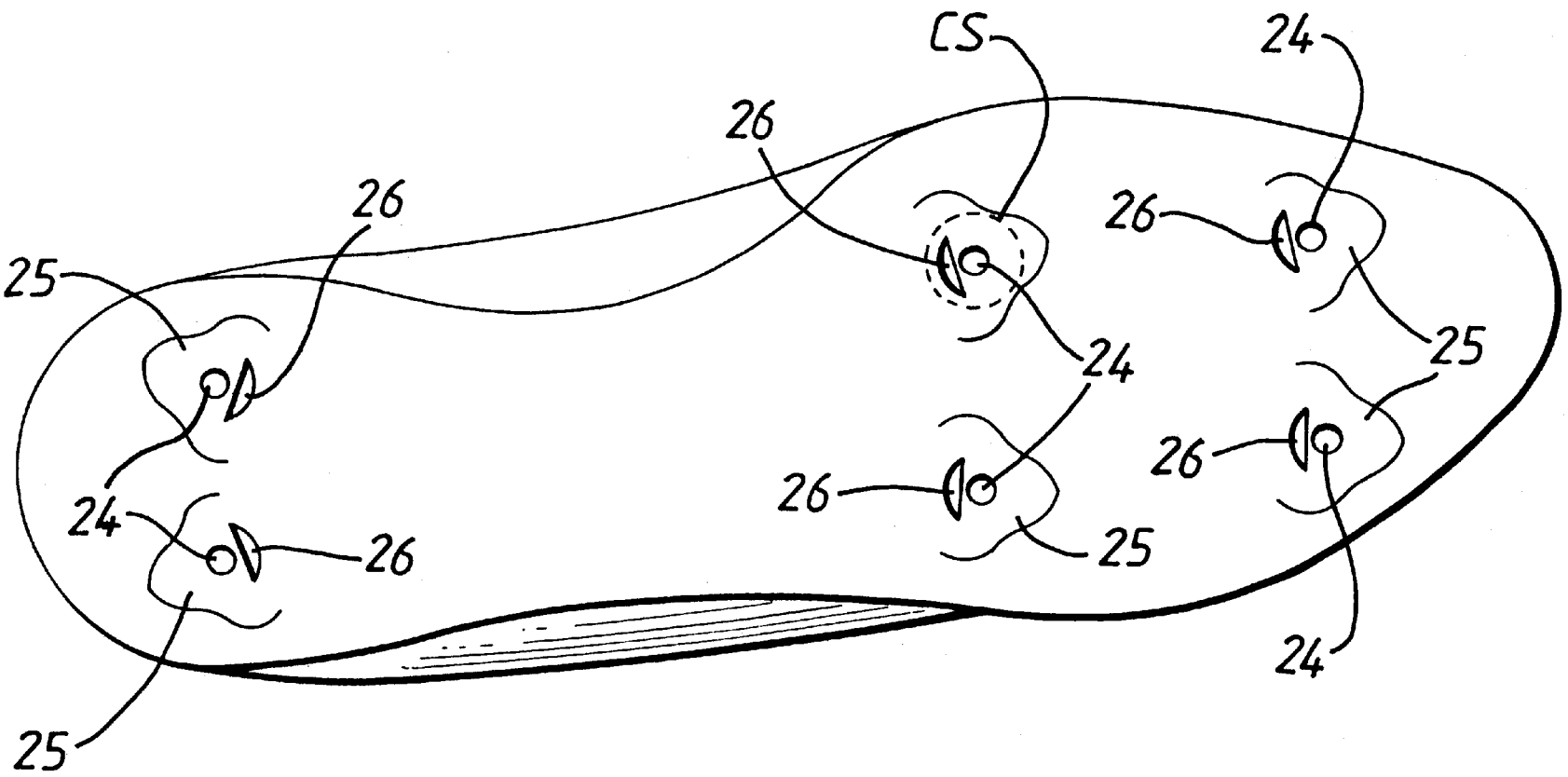
FIG. 3 is a view of the sole with the studs removed.

To assure these desired orientations when fitting the studs, each stud-receiving region of the sole has, in addition to the flat area 25 and the threaded socket 24, a hole 26 of the same cross-sectional shape as of the lug 35 on the stud body, and positioned relative to the screw hole 24 when shaping the sole so that the median line through the two corresponds with the desired drive line direction for each stud, as seen by comparing FIG. 3 and FIG. 1.

To fit the stud, the stud body 3 is aligned over the fixing region 25, the lug 35 pushed down into the recess 26 of the sole and the bolt 4 inserted and screwed home. Alternatively the stud and bolt may be introduced together and the bolt initially engaged before manoeuvring the lug 35 into the hole 26; the bolt 4 and stud body 3 are axially relatively slidable to permit this. There are helpful visual indicators: firstly the crescent flange 36 on the drive face on the stud is easily matched with the correspondingly-shaped crescent recess 26 in the sole; secondly the flat regions 25 on the sole have shaped outlines corresponding to the stud base outlines seen in FIGS. 2(*b*),(*c*).

The bolt 4 is then tightened down using the spanner; its head 42 is partly recessed within the top of the stud body and retains the stud body by engagement against an upward shoulder 51 near the top of the bore 50. Recessing the bolt head 42 reduces its non-directional contribution to the stud's flow characteristics.

FIG. 4 shows a second form of stud differing from that previously described only in the form of its locating lug 35*a*. This is a rib in the form of an arc of a circle concentric with the bolt hole 50. It is for use with soles having complementary arcuate recesses. Having explained how the stud's fixing system assures orientation of the studs' perpendicular drive surfaces 31 along the drive lines of the sole, we return to complete the description of the stud body's other features.

As explained previously, to obtain directional properties the opposite side of the stud must be flow-compliant relative to the flow-resistant drive face 31. It will then be relatively easily pushed through the more or less flowable ground surface in the direction opposite to the drive direction. In particular, in the present embodiment the drive face 31 projects a larger absolute area as well as a larger high-angle area along the drive line DL than a conventional stud (indicated by a broken line CS in FIG. 2(*b*)), and this might interfere with the necessary forward skidding associated with kicking a ball. The present stud might indeed be regarded as a conventional stud modified by flattening one face and adding wing extensions to that face. So, the other side ("compliant side") is specially shaped to reduce its relative flow resistance. Firstly, the leading edge or median ridge 34 of the compliant side is steeply inclined from foot to top and is a smooth continuous curve. In this embodiment the overall inclination angle is about 40 degrees to the axial direction for the line X—X in FIG. 2(*f*). Then, the flank regions 33 diverge from the leading edge 34 back to the shoulder 32 bordering the drive face 31, diverging non-abruptly from the drive line direction from the leading edge 34 to the shoulder 32 . In this embodiment the overall divergence of the line Y—Y in FIG. 2(*c*) from the drive line is about 40 degrees. This is at the base level of the stud. Since these surfaces are also inclined towards the axis as they rise from the base, they present low flow-resistance all the way up the stud body.

The stud body furthermore presents a low flow-resistance (high compliance) in the two directions perpendicular to the drive line (see FIG. 2(*f*)), since the presented profile is essentially the same as that from the drive line compliance direction but with part cut away. This lateral compliance provides important rotational "give" in the forefoot area, avoiding unwanted grip when turning the foot which can lead to leg and ankle injuries.

The rotational "give" is supplemented by the forefoot stud disposition as shown in FIG. 1; the studs' respective drive lines are not exactly parallel but inclined towards a common turning centre so that turning about that centre does not engage any stud's drive surface.

Shaping of the compliant side is limited by the need for the stud to penetrate the ground in order to do its job. In the present stud the penetration of the inclined compliant surfaces is improved by making them concave in axial planes. See FIGS. 2(*a*),(*d*) and (*f*). Without introducing abrupt flow-resistant surfaces, these concavities reduce the rate of initial increase in radial cross-section from the top of the stud down, so that an effective area of the drive surface 31—which in itself offers no resistance to penetration—easily enters the ground. Computer-simulated fluid flow tests have been carried out for this form of stud, to assess the effect for mud behaving as a viscous fluid. In particular we noticed two phenomena.

Firstly, when the stud acts with maximum resistance against flow directed onto its drive surface, the "form drag" attributable to the abrupt drive surface is substantially supplemented by "friction drag" associated with the large surface area of the stud on the inclined downstream side.

Secondly, because the abrupt drive surface interrupts and distorts flow to an extreme extent, we find that flow past the stud requires disturbances in the ground surface well out beyond the sides of the stud and this accounts for a high level of drag. More particularly, where two adjacent studs are positioned sufficiently close side-by-side that their zones of flow distortion overlap, the studs start to behave like a continuous bar whose effect extends right across and indeed potentially beyond the sole.

It will be understood that the stud configuration described here could also be used with non-detachable studs, or with other kinds of detachable studs provided that appropriate care is taken to align the studs properly. An advantage of the present embodiment is that the sole is also suitable for use with conventional studs; the stud-receiving regions 25 are externally flat and, as seen with the reference to the line CS in FIG. 2(*b*), the base of a conventional stud will cover the recess 26. Thus, a player may if wished use a mixture of different kinds of studs on the one sole.

What is claimed is:

1. A directional stud having a stud axis for sports footwear having a sole, the directional stud comprising:

an abrupt drive face substantially parallel to the stud axis and directed in a first radial direction relative to the stud axis;

shoulder regions bordering the abrupt drive face, the shoulder regions converging towards the stud axis away from the sole;

a median ridge on the stud opposite the abrupt drive face, the median ridge inclining towards the stud axis away from the sole and flank regions extending from respective shoulder regions to the median ridge, the flank regions inclining relative to the stud axis and so as to converge towards the stud axis away from the sole, and each flank region converging in a radial plane towards the stud axis from the shoulder regions to the median ridge, the flank regions furthermore being concave in a radial plane between the respective shoulder regions and the median ridge;

whereby the flank regions and median ridge together form a compliant side of the directional stud, the compliant side directed radially oppositely to the first radial direction of the abrupt drive face, the abrupt drive face presenting a first resistance to movement of each directional stud in the first radial direction through a flowable ground surface material, the compliant side of each directional stud presenting a second resistance to movement of each directional stud directed radially oppositely to the first radial direction through the flowable ground surface material, the first resistance being higher than the second resistance.

2. The directional stud according to claim 1, wherein the abrupt drive face is substantially flat.

3. Sports footwear having a sole, a plurality of directional studs having a stud axis projecting from the sole, each directional stud comprising:

an abrupt drive face substantially parallel to the stud axis and directed in a first radial direction relative to the stud axis;

shoulder regions bordering the abrupt drive face, the shoulder regions converging towards the stud axis away from the;

a median ridge on each directional stud opposite the abrupt drive face, the median ridge inclining towards the stud axis away from the; and flank regions extending from respective shoulder regions to the median ridge, the flank regions inclining relative to the stud axis so as to converge towards the stud axis away from the sole, each flank region converging in a radial plane towards the stud axis from the shoulder regions to the median ridge, the flank regions furthermore being concave in a radial plane between the respective shoulder regions and the median ridge;

whereby the flank regions and median ridge together form a compliant side of each directional stud, the compliant side directed radially oppositely to the first radial direction of the abrupt drive face, the abrupt drive face presenting a first resistance to movement of each directional stud in the first radial direction through a flowable ground surface material, the compliant side of each directional stud presenting a second resistance to movement of each directional stud through the flowable ground surface material directed radially oppositely to the first radial direction, the first resistance being higher than the second resistance, and in which the sole has a forefoot region and a heel region, and the drive face of a majority or all of the directional studs on the forefoot region of the sole, is directed towards the heel region of the sole and the drive face of a majority or all of the directional studs on the heel region of the sole is directed towards the forefoot region of the sole.

4. Sports footwear according to claim 3 in which the convergent flank regions and shoulders are concave in axial planes.

5. Sports footwear as defined in claim 1 in which the studs are detachable from the sole.

6. Sports footwear as defined in claim 5 in which one or more studs are releasably securable to the sole by engagement of a rotational fastener portion of the stud with a complementary rotational fastener portion of the sole, a base of the stud additionally having a stud alignment formation engageable in axial overlap with an alignment formation of the sole to hold a predetermined rotational orientation of the stud relative to the sole when securing the stud.

7. Sports footwear according to claim 6 in which the rotational fastener portion of the stud is rotatable relative to the alignment formation on the stud.

8. Sports footwear according to claim 7 in which the rotational fastener portion of the stud is axially movable relative to the alignment portion of the stud.

9. Sports footwear according to claim 6 in which the alignment formation on the stud comprises a fixed integral projection from the foot of the stud engageable in a corresponding recess of the sole.

10. The sports footwear according to claim 3, wherein the abrupt drive face is substantially flat.

* * * * *